US011759064B1

(12) United States Patent
Calzaretta et al.

(10) Patent No.: US 11,759,064 B1
(45) Date of Patent: Sep. 19, 2023

(54) APPARATUS FOR TOILET SEAT LIFTING

(71) Applicants: Scott Howard Calzaretta, Marin, CA (US); Gary David Mallet, Caldwell, ID (US); Michael Szary Harmell, San Francisco, CA (US)

(72) Inventors: Scott Howard Calzaretta, Marin, CA (US); Gary David Mallet, Caldwell, ID (US); Michael Szary Harmell, San Francisco, CA (US)

( * ) Notice: Subject to any disclaimer, the term of this patent is extended or adjusted under 35 U.S.C. 154(b) by 0 days.

(21) Appl. No.: 17/834,741

(22) Filed: Jun. 7, 2022

Related U.S. Application Data

(60) Provisional application No. 63/313,070, filed on Feb. 23, 2022.

(51) Int. Cl.
*A47K 13/10* (2006.01)
*A61G 5/14* (2006.01)

(52) U.S. Cl.
CPC ..... *A47K 13/10* (2013.01); *A61G 5/14* (2013.01)

(58) Field of Classification Search
CPC ..... A47K 13/10
USPC ..... 4/246.1
See application file for complete search history.

(56) References Cited

U.S. PATENT DOCUMENTS 5,661,858 A 9/1997 House et al.
6,553,585 B1 * 4/2003 Lundstrom ..... A61G 7/1007 4/667
6,598,246 B1 * 7/2003 Shou ..... A61G 7/1094 297/DIG. 10
6,643,866 B1 * 11/2003 Stewart ..... A61G 7/1017 4/667
8,336,130 B1 12/2012 Cardenas
10,624,508 B2 4/2020 Duarte
11,350,803 B2 5/2022 Hall
11,363,920 B2 6/2022 Hall
2005/0268389 A1 * 12/2005 Meloche ..... A47K 13/10 4/246.1
2010/0219668 A1 9/2010 Nelson
2015/0257956 A1 9/2015 Wang
2021/0307571 A1 * 10/2021 Chung ..... A61G 7/1007

FOREIGN PATENT DOCUMENTS

JP 2006020682 A 1/2006
JP 2011144623 A 7/2011
KR 20090008564 U 8/2009

OTHER PUBLICATIONS

International Search Report for Application No. PCT/US2023/063065 dated May 15, 2023.

* cited by examiner

*Primary Examiner* — Christine J Skubinna
(74) *Attorney, Agent, or Firm* — Artegis Law Group, LLP

(57) ABSTRACT

Various embodiments set forth an apparatus comprising a base assembly configured to be positioned around a base of a toilet, a movable portion mechanically coupled to the base assembly, and a set of lifting components that lift the movable portion away from a portion of the base assembly.

17 Claims, 10 Drawing Sheets

APPARATUS FOR TOILET SEAT LIFTING

CROSS-REFERENCE TO RELATED APPLICATIONS

This application claims the priority benefit of U.S. Provisional Patent Application titled, "Apparatus for Toilet Seat Lifting," filed on Feb. 23, 2022, having Application Ser. No. 63/313,070. The subject matter of this related application is hereby incorporated herein by reference in its entirety.

BACKGROUND

Field of the Various Embodiments

Embodiments disclosed herein generally relate to mechanical devices and, more specifically, to an apparatus for toilet seat lifting.

Description of the Related Art

Toilets are generally designed to accommodate a wide range of users of varying heights, where a given user sits on a toilet seat above a toilet base. When complete, the user performs a sit-to-stand motion in order to separate from the toilet seat. However, various users have difficulty performing the sit-to-stand motion. For example, some users have injuries, weak muscles or joints, preventing the user from performing such motions without assistance. Further, a user sitting on the toilet for prolonged periods can further contribute to the bodily weakness in the user, causing further difficulty in performing the sit-to-stand motion.

Various devices exist in the prior art that assist the user in rising from a toilet seat. For example, some toilet systems are designed such that the user is not in a sitting position while upon the toilet. However, such systems are not compatible with existing toilets or toilet seats. Other toilet systems include fixed bars installed proximate to the toilet that assist a user to rise from a sitting position by pushing or pulling on the bar. However, these systems are large and typically cannot be installed in certain facilities due to the constraints around a given toilet.

In light of the above, more effective techniques for assisting users engage with a toilet would be useful.

SUMMARY

Various embodiments include an apparatus comprising a base assembly configured to be positioned around a base of a toilet, a movable portion mechanically coupled to the base assembly, and a set of lifting components that lift the movable portion away from a portion of the base assembly.

At least one technological advantage of the toilet seat lifting assembly relative to the prior art is that, with the disclosed apparatus, the toilet seat lifting assembly can be fixed to a conventional toilet and provide mechanical assistance when a user performs a sit-to-stand motion when rising from the toilet. Further, as the toilet seat lifting apparatus is configured to fit around a conventional toilet, the toilet seat lifting assembly can be installed on conventional toilets in small areas, enabling the assembly to be used in areas that are not suitable for other user assistance systems. These technical advantages provide one or more technological advancements over prior art approaches.

BRIEF DESCRIPTION OF THE DRAWINGS

So that the manner in which the above-recited features of the present disclosure can be understood in detail, a moreparticular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally-effective embodiments.

DETAILED DESCRIPTION

In the following description, numerous specific details are set forth to provide a more thorough understanding of the embodiments of the present invention. However, it will be apparent to one of skill in the art that the embodiments of the present invention may be practiced without one or more of these specific details.

Embodiments disclosed herein include a toilet seat lifting assembly that assists users in transitioning from a seated position to a standing position. The toilet seat lifting assembly can be configured to rest around a toilet base and includes components that enable the toilet seat lifting assembly to be fixed to the toilet seat base. The toilet seat assembly includes a fixed base assembly and a movable portion that is partially attached to the fixed base via one or more lifting mechanisms. In operation, the lifting mechanisms provide a directional force to a movable portion that transfers the energy associated with the directional force to an object positioned on the movable portion, such as the legs of a user when seated on a toilet seat attached to the movable portion. The energy provided by the toilet seat lifting assembly enables a user sitting on a toilet to transition to a standing position.

Figure 1:
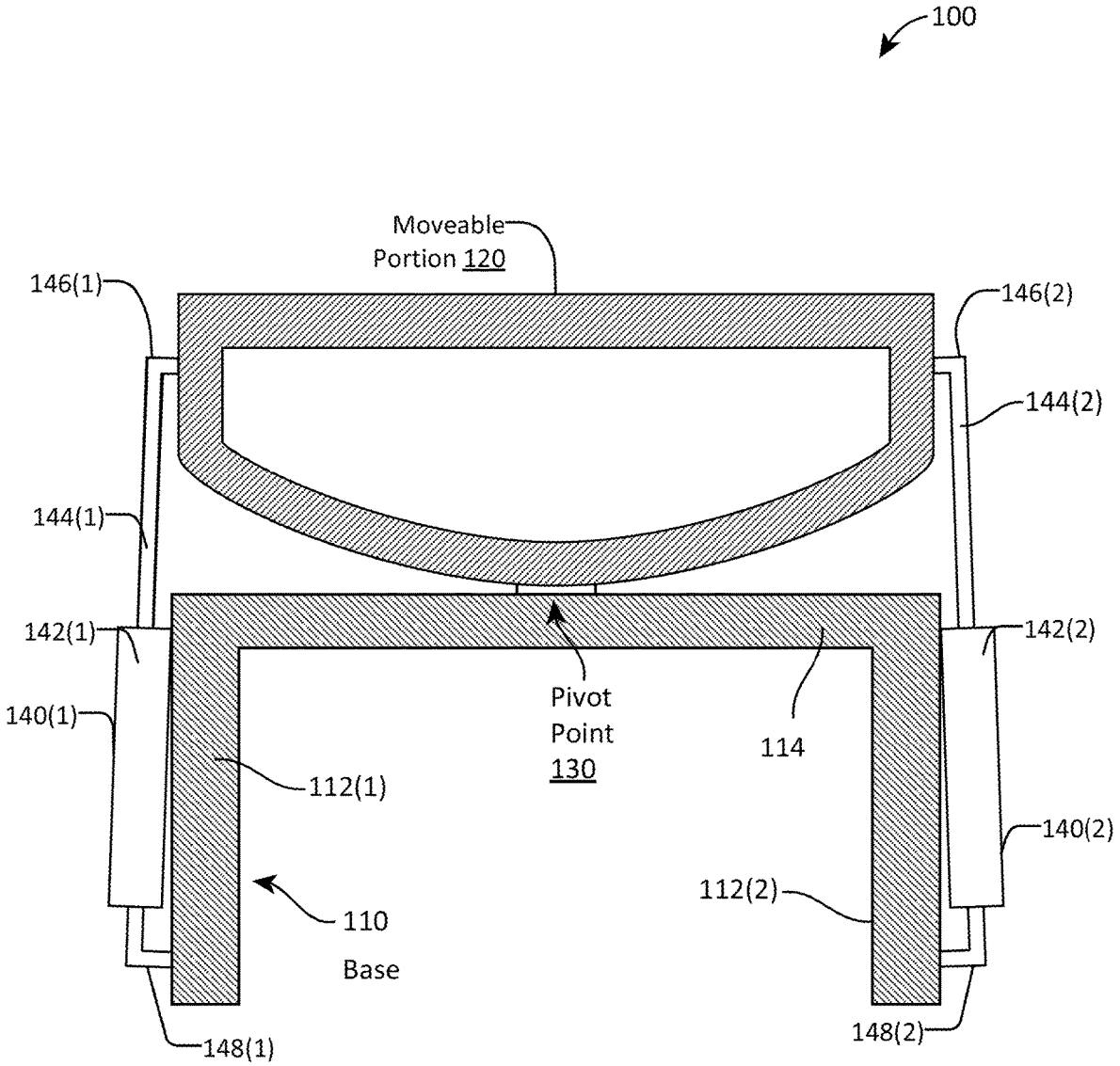
FIG. 1 illustrates a front view of a toilet seat lifting assembly, according to various embodiments.

FIG. 1 illustrates a front view of a toilet seat lifting assembly 100, according to various embodiments. As shown, the toilet seat lifting assembly 100 includes, without limitation, a base assembly 110, a movable portion 120, a pivot point 130, and one or more lifting mechanisms 140 (e.g., 140(1), 140(2), etc.). The base assembly 110 includes one or more leg portions 112 and one or more top portions 114. In various embodiments, the lifting mechanism 140 can include a shock housing 142, a shock piston 144, a first connection point 146, and a second connection point 148.

In various embodiments, the toilet seat lifting assembly 100 comprises metal (e.g., steel), carbon fiber, plastic, composite materials, and/or any other material capable of supporting a user and providing energy by, for example, applying an upward force, applying a torque, and/or applying other types of forces to the user. The base assembly 110 can be configured to stand around a toilet base. For example, the base assembly 110 can include one or more legs 112 that rest on a ground proximate to a toilet base and can support the mass of a user in addition to or in lieu of the support provided by the toilet base.

The toilet seat lifting assembly 100 includes a movable portion 120 that is mechanically attached to the top portion 114 of the base assembly 110. In various embodiments, the movable portion 120 can be attached to the base assembly 110 via one or more connection points. For example, the movable portion 110 can be attached to the base assembly 110 via the pivot point 130 and the set of one or more lifting mechanisms 140. In operation, the set of lifting mechanisms 140 move the movable portion 120 from resting on the top portion 114 to a position away from the base assembly 110. In various embodiments, the movable portion 120 can be mechanically attached to the top portion 114 of the base assembly 110 at a first position using an attachment mechanism such as the pivot point 130. For example, the pivot point 130 can be included in a hinge that attaches to the movable portion 120 and the base assembly 110. In such instances, the lifting mechanism 140 can apply lifting forces to the movable portion 120 to cause the movable portion 120 to rotate around the pivot point 130. In another example, a set of one or more gears can connect the movable portion 120 to the base assembly 110.

In various embodiments, the movable portion 120 can be mechanically attached to the base assembly via the one or more lifting mechanisms 140. In such instances, the lifting mechanism 140 can include a connecting element that connects to the movable portion 120 at the connection point 146 and a connecting element that connects to the leg 112 of the base assembly 110 at the connection point 148.

In some embodiments, the lifting mechanisms 140 can include various types of mechanical and/or electrical components that act as actuation mechanisms. For example, various types of lifting mechanisms can include switches, actuators, shocks, struts, jacks, threaded screws, and so forth. For example, the lifting mechanism 140 can comprise a telescoping hydraulic shock, where mechanical resistance controls the rise and descent of the movable portion 120 via the extension and/or contraction of the shock piston 144 in the shock housing 142. In such instances, the shock piston 144 extending out from the shock housing 142 can provide a lifting force upon the movable portion 120 via the connection point 146. In another example, the lifting mechanism 140 can include an electrical switch or trigger. In such instances, a user can provide an input to the electrical trigger in order to cause the lifting mechanism 140 to provide force to the moving portion 120 in order to lift the moving portion 120.

Figure 2:
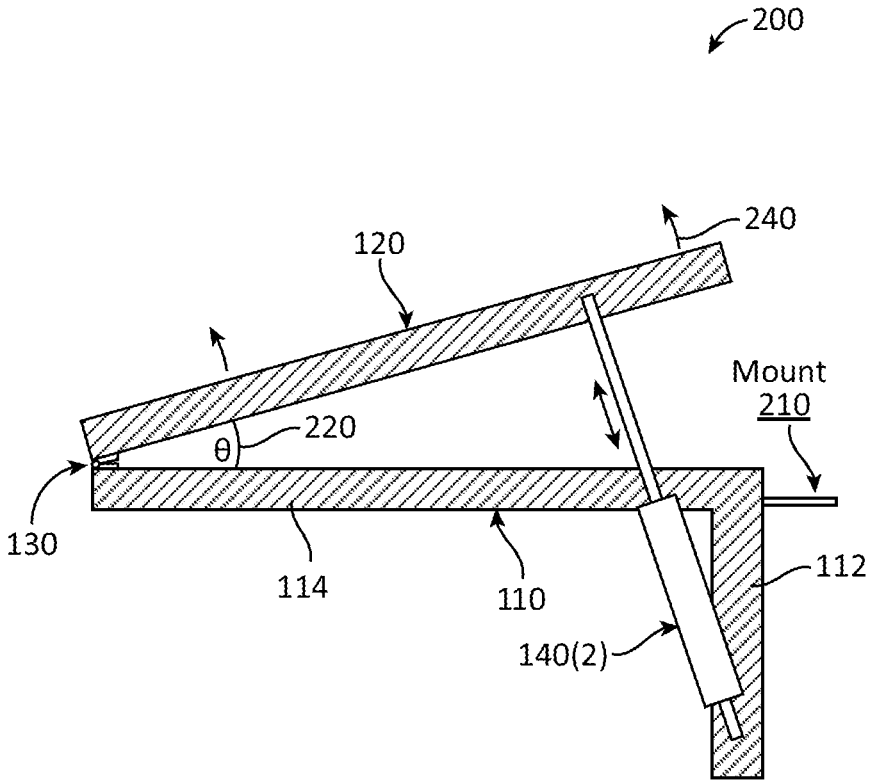
FIG. 2 illustrates a side view of the toilet seat lifting assembly of FIG. 1, according to various embodiments.

FIG. 2 illustrates a side view 200 of the toilet seat lifting assembly 100 of FIG. 1, according to various embodiments. As shown, the toilet seat lifting assembly 100 includes, without limitation, the base assembly 110, the movable portion 120, the pivot point 130, and the lifting mechanism 140. The base assembly 110 includes leg portion 112, top portion 114, and one or more mounts 210.

In operation, the set of lifting mechanisms 140 provides a directional force. The pivot point 130 causes the directional force to be converted to a torque 240 to an object positioned on the movable portion 120, such as the legs of a user when seated on a toilet seat attached to the movable portion 120. In various embodiments, the torque 240 provided by the toilet seat lifting assembly 100 can be based on the angle 220 formed between the top portion 114 of the base assembly 110 and the movable portion 120, where energy provided to the user via the generated torque 240 enables a user to transition to a standing position.

In some embodiments, the base assembly 110 can include various attachment points and/or attachment slots (not shown). In such instances, the lifting mechanism 140 can be attached to the base assembly 110 at one of the attachment points. For example, the second connection point 148 of the lifting mechanism 140 can attach to the base assembly 110 at an attachment point located on the leg 112. In some embodiments, the attachment points can affect the lifting force that the lifting mechanism 140 applies on the movable portion 120. For example, when the connection point 148 is attached to the base assembly 110 closer to the top portion 114, the lifting mechanism 140 may apply a smaller lifting force.

The set of one or more mounts 210 can include various slots, brackets, or other connection points to fix the base assembly 110 to a portion of a toilet. For example, the mounts can include slots to attach the mount 210 to a back of a toilet base. In various embodiments, the set of mounts 210 can be positioned such that the base legs 112 rest on above the floor adjacent to the toilet base.

Figure 3:
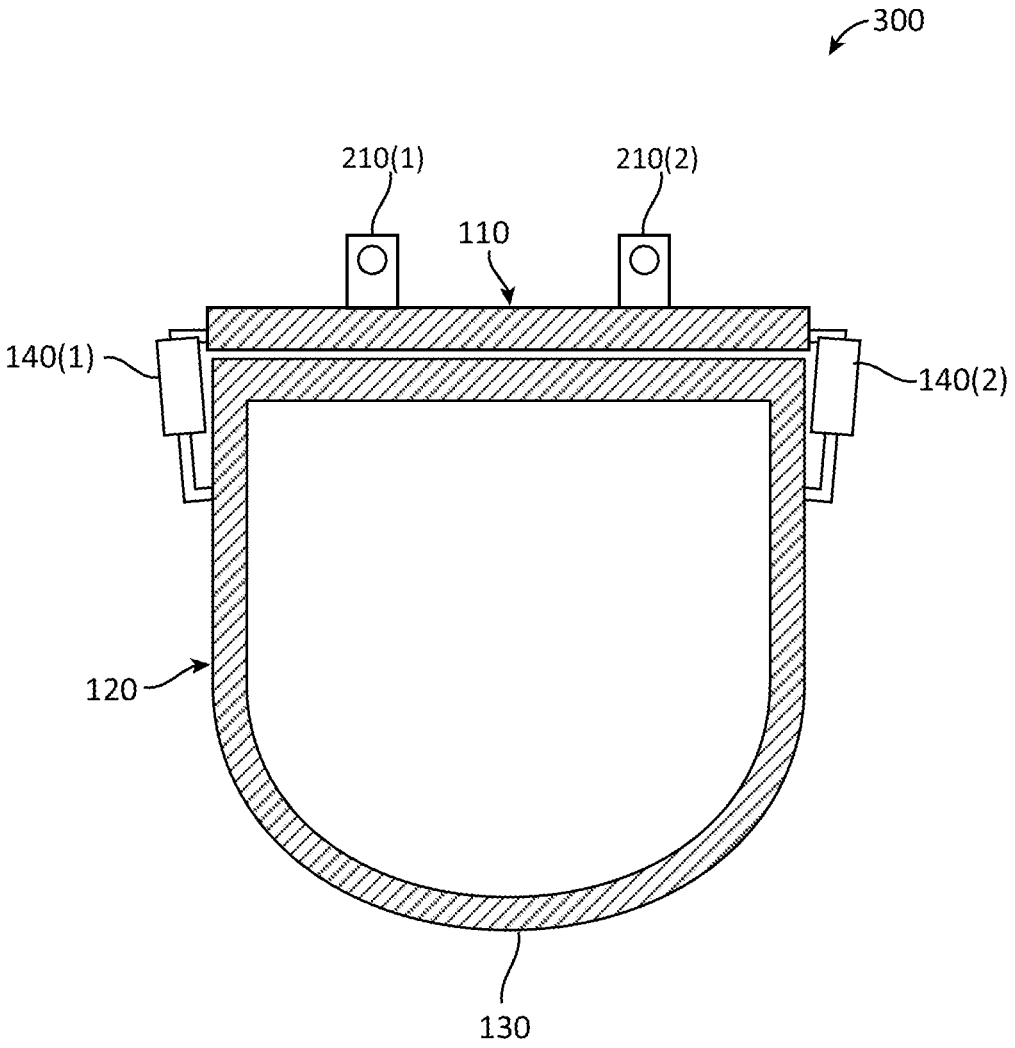
FIG. 3 illustrates a top view of the toilet seat lifting assembly of FIG. 1, according to various embodiments.

FIG. 3 illustrates a top view 300 of the toilet seat lifting assembly 100 of FIG. 1, according to various embodiments. As shown, the toilet seat lifting assembly 100 includes, without limitation, the base assembly 110, the movable portion 120, the pivot point 130, and the one or more lifting mechanisms 140. The base assembly 110 includes the one or more mounts 210.

In various embodiments, the base assembly 110 can include the set of mounts 210 opposite to the pivot point 130. In such instances, the base assembly 110 can remain stable when the lifting mechanism 140 provides the torque 240 to the movable portion 120.

Figure 4:
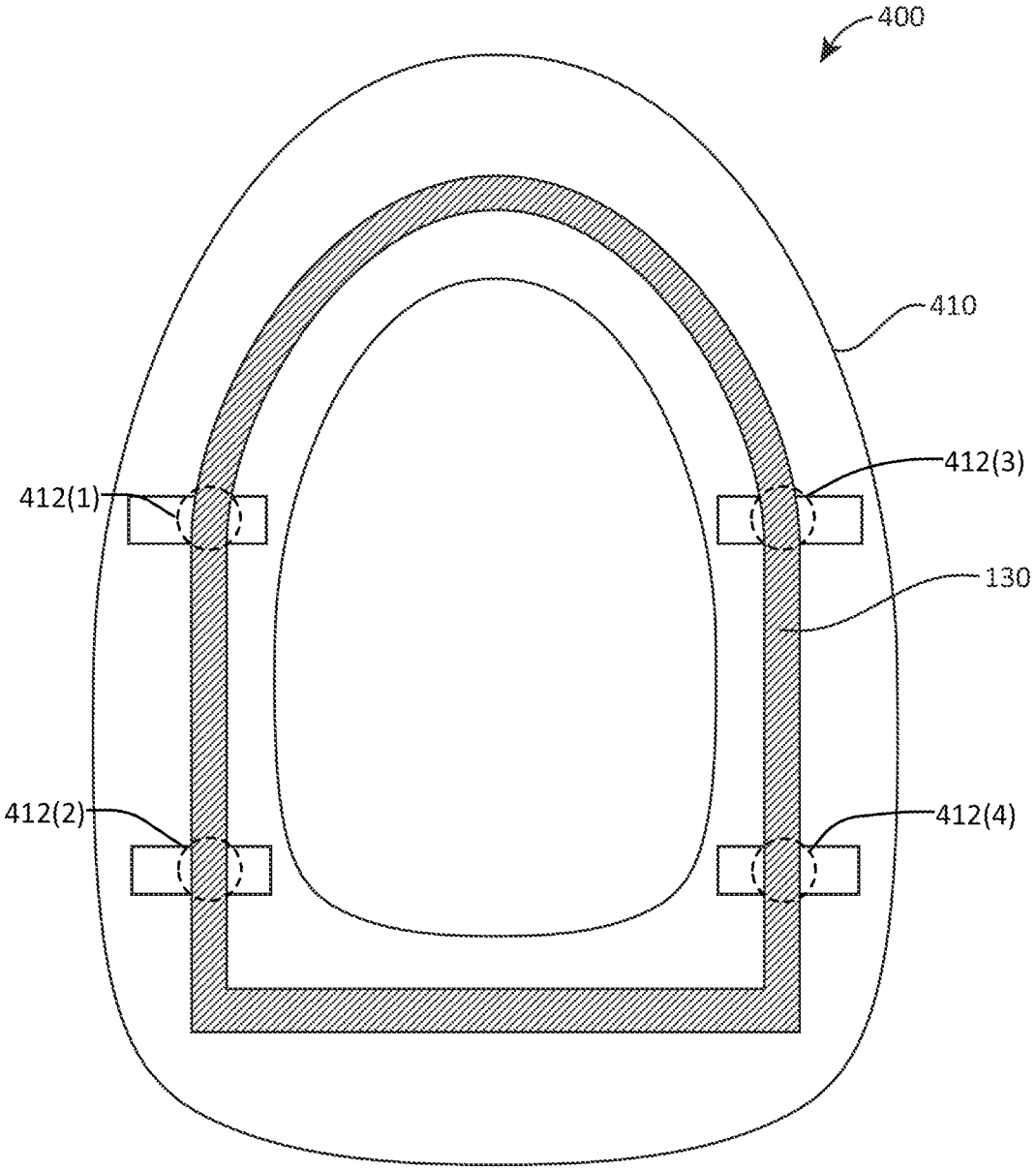
FIG. 4 illustrates a bottom view of a toilet seat coupled to the movable portion of the toilet seat lifting assembly of FIG. 1, according to various embodiments.

FIG. 4 illustrates a bottom view of a toilet seat coupled to the movable portion of the toilet seat lifting assembly of FIG. 1, according to various embodiments. As shown, the toilet set lifting assembly 400 includes, without limitation, the movable portion 120, a toilet seat 410, and a set of connection points 412.

In various embodiments, the movable portion 120 can be configured to accommodate the space within a conventional toilet seat 410. For example, the movable portion 120 can include a partial oval shape that corresponds to the shape of at least a portion of the toilet seat 410. Additionally or alternatively, the movable portion 120 can include various attachment mechanisms (not shown) to mechanically attach the movable portion 120 to the toilet seat 410 at the attachment points 412. For example, the attachment points 412 can include various types of connection mechanisms (e.g., mounts, brackets, slots, etc.) that are configured to connect the movable portion to parts of the toilet seat 410 such that the toilet seat 410 remains fixedly secure during use.

Figure 5:
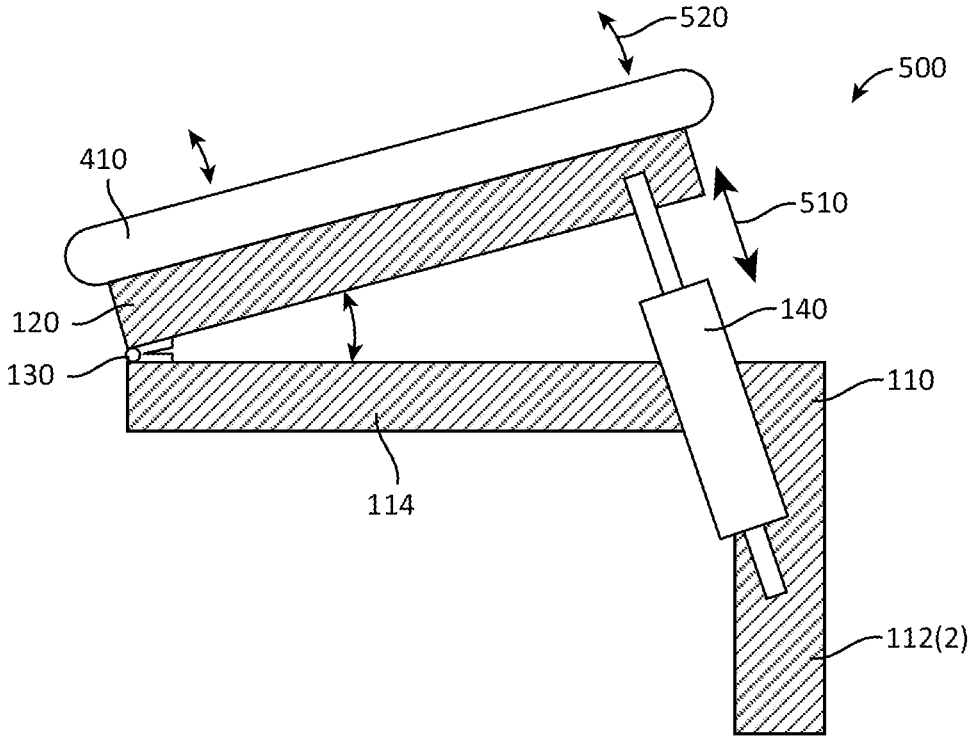
FIG. 5 illustrates a side view of the toilet seat lifting assembly of FIG. 1 when the lifting mechanism is engaged, according to various embodiments.

FIG. 5 illustrates a side view of the toilet seat lifting assembly of FIG. 1 when the lifting mechanism is engaged, according to various embodiments. As shown, the toilet seat lifting assembly 500 includes, without limitation, the base assembly 110, the movable portion 120, the pivot point 130, and the lifting mechanism 140. The base assembly 110 includes leg portion 112 and the top portion 114.

The toilet seat lifting assembly 500 can use one or more leverage points (e, the pivot point 130) and angles to raise parts of the movable portion 120 above a normal resting position. For example, the lifting mechanism 140 can be a shock that is connected to a point on the movable portion 120 on an opposite end of the point where the movable portion 120 is attached to the pivot point 130. The attachment positions on the movable portion 120 can serve as leverage points that convert the directional force 510 generated by the lifting mechanism 140 into a torque 520 applied to a user. In some embodiments, the lifting mechanism can provide force to rotate the moving portion 120 within a range of angles. For example, the lifting mechanism can move the moving portion from an angle of 0° relative to the base portion 110 to an angle of 90° relative to the base portion 110.

Figure 6A:
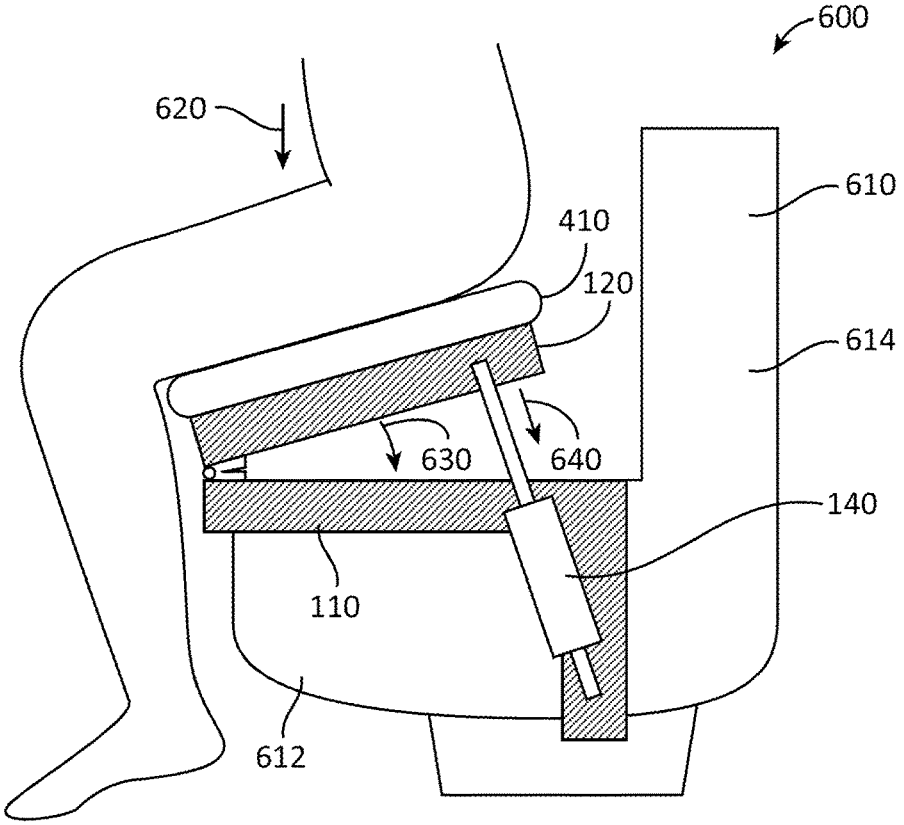
FIG. 6A illustrates a side view of a user initiating a sitting motion on the toilet seat lifting assembly of FIG. 1, according to various embodiments.
Figure 6B:
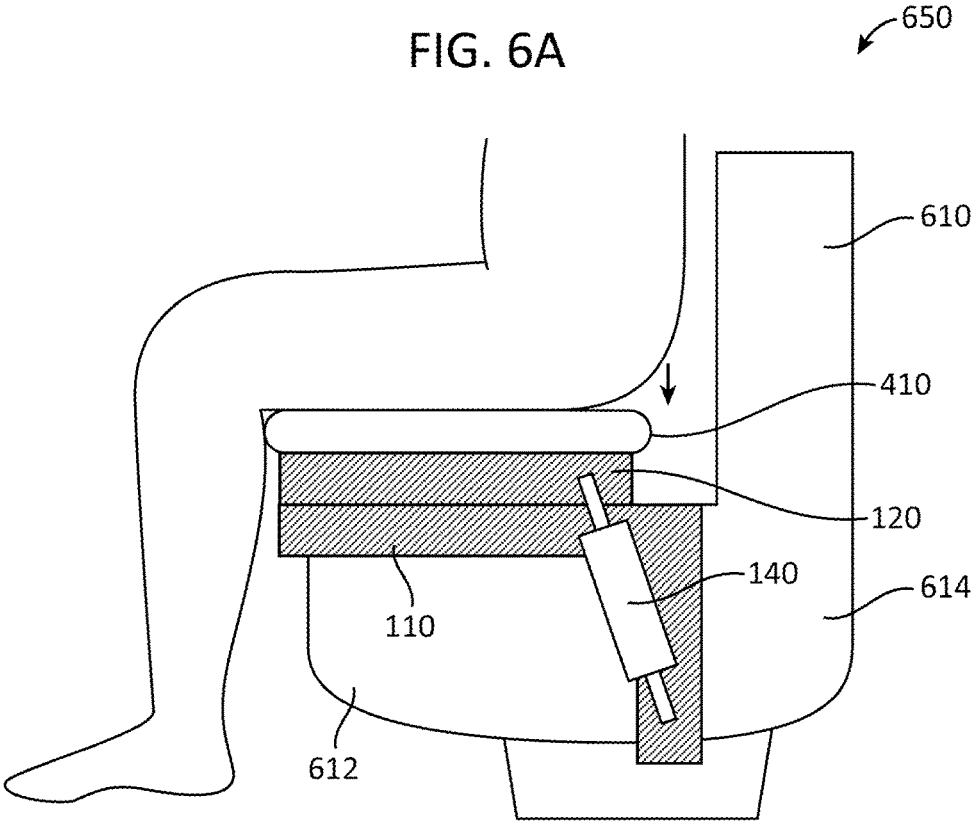
FIG. 6B illustrates a side view of a user completing a sitting motion of the toilet seat lifting assembly of FIG. 1, according to various embodiments.

FIG. 6A-6B illustrates a side view of a user initiating (configuration 600) and completing (configuration 650) a sitting motion on the toilet seat lifting assembly 100 of FIG. 1, according to various embodiments. As shown, the toilet configurations 600, 650 include, without limitation, the toilet seat lifting assembly 100 and a toilet 610. The toilet includes a toilet base 612 and a toilet back 614. The toilet seat lifting assembly 100 includes the base assembly 110, the movable portion 120, and the lifting mechanism 140.

In operation, the toilet seat lifting assembly 100 can be installed on an existing structure, such as a toilet base 612. Additionally or alternatively, the base assembly 110 can include multiple legs (e.g., 2-6 legs, etc.) to provide stability from the ground in addition to being fixedly secure to the toilet base 612.

In various embodiments, a user initiates a sitting motion 620 atop the toilet seat 410, providing a downward force. The downward force provides a torque 630 that causes a compression 640 of the lifting mechanism 140. When the user completes the sitting motion, the legs of the user rest upon the toilet seat 410, while the movable portion 120 rests upon the top portion 114 of the base assembly 110. Th energy stored in the lifting mechanism 140 can later be transferred to the toilet seat 140 as a torque 520.

Figure 7A:
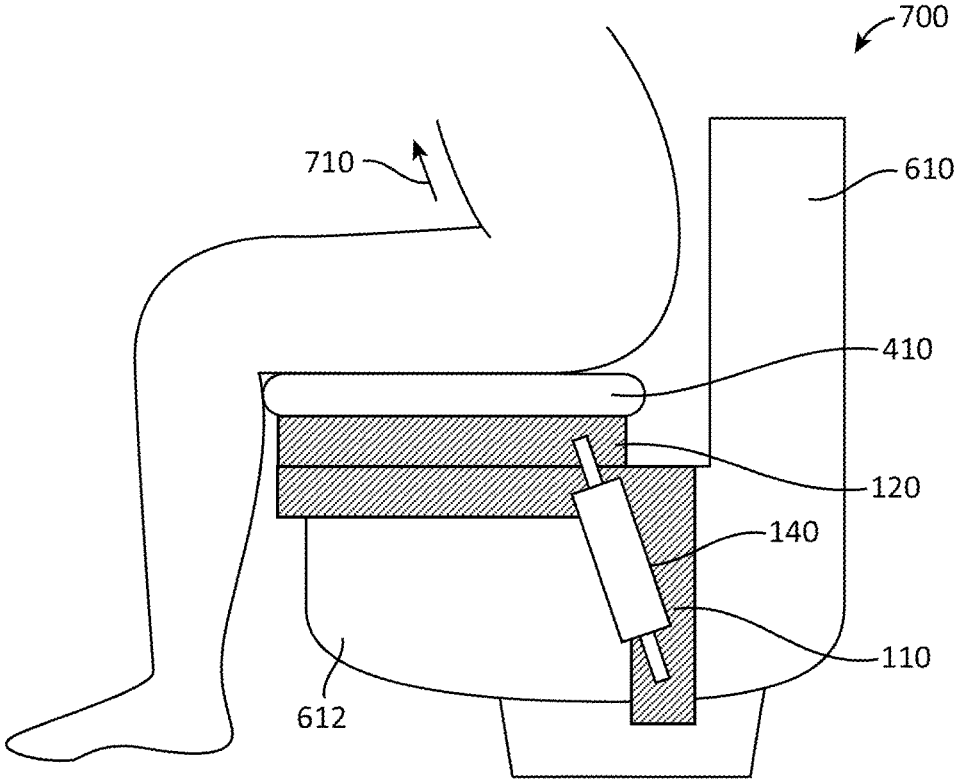
FIG. 7A illustrates a side view of a user initiating a standing motion from the toilet seat lifting assembly of FIG. 1, according to various embodiments.
Figure 7B:
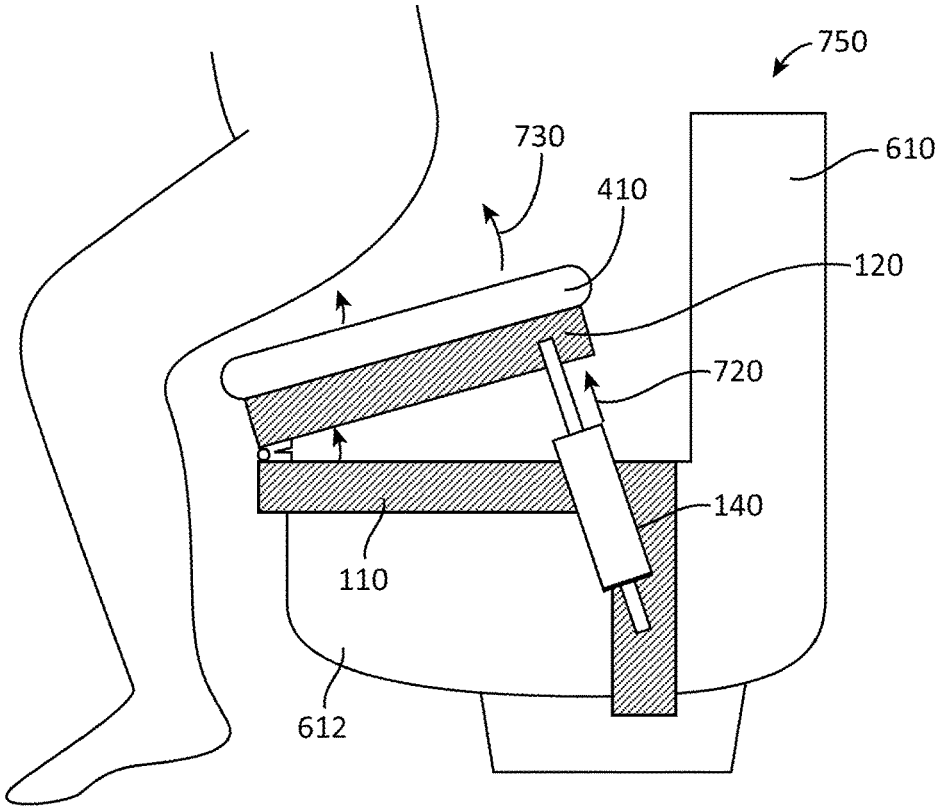
FIG. 7B illustrates a side view of a user completing a standing motion from the toilet seat lifting assembly of FIG. 1, according to various embodiments.

FIG. 7A-7B illustrates a side view of a user initiating (configuration 700) and completing (configuration 750) a standing motion from the toilet seat lifting assembly of FIG. 1, according to various embodiments. As shown, the toilet configurations 700, 750 includes, without limitation, the toilet seat lifting assembly 100 and a toilet 610. The toilet includes a toilet base 612 and a toilet back 614. The toilet seat lifting assembly 100 includes the base assembly 110, the movable portion 120, and the lifting mechanism 140.

In various embodiments, a user initiates a standing motion by performing a weight shift movement 710 to initiate a sit-to-stand motion. In some embodiments, the lifting mechanism 140 can respond to the weight shift movement by providing a directional force 720 that causes the movable portion 120 and the toilet seat 410 to provide a torque 730 to the user, supplementing the force that the user is exerting to perform the sit-to-stand motion.

Alternatively, in some embodiments, the user can provide a different trigger to the seat lift assembly 100. For example, a user can provide an input to an electronic trigger. In such instances, the lifting mechanism 140 can respond to the electronic trigger by providing the directional force 720. Other types of triggers can also cause the lifting mechanism 140 to provide the directional force 720. For example, the user can provide force to a separate arm, pedal, or other trigger connected to the lifting mechanism 140. Further, other types of electronic data (e.g., data provided by image sensors, motion sensors, natural language processors) can cause the lifting mechanism 140 to provide the directional force 720.

Figure 8:
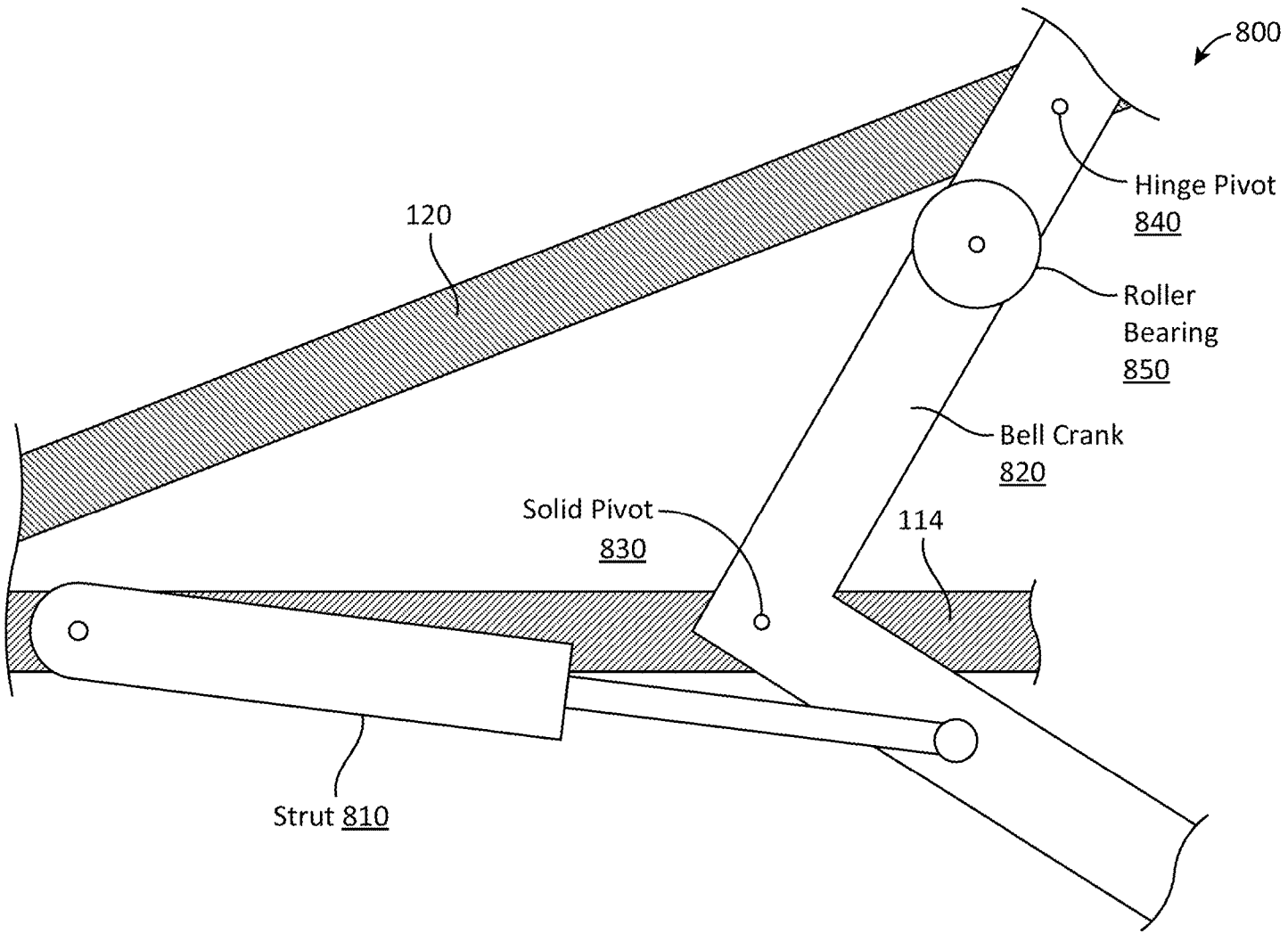
FIG. 8 illustrates a side view of the toilet seat lifting assembly of FIG. 1 that includes an alternative lifting mechanism, according to various embodiments.

FIG. 8 illustrates a side view of the toilet seat lifting assembly 100 of FIG. 1 that includes an alternative lifting mechanism, according to various embodiments. As shown, the toilet seat lifting assembly 800 includes, without limitation, the top portion 114 of the base assembly 110, the movable portion 120, a strut 810, and a bell crank 820. The bell crank 820 includes a solid pivot 830, a hinge pivot 840, and a roller bearing 850.

In various embodiments, the toilet seat lifting assembly 100 can include a different type of lifting mechanism 140. For example, the toilet seat lifting assembly 800 includes a lifting mechanism 140 that includes a strut 810 connected on one end to the top portion 114 of the base assembly 110 and connected on the opposite end to a bell crank 820. The bell crank 820 can be fixed at one point to the top portion 114, creating a solid pivot 830 at the connection point to the top portion 114. The bell crank 820 can be connected to the movable portion 120 at a different position, forming a hinge pivot 840 at the connection point to the movable portion 120.

In operation, the strut 810 can provide a directional force away from the pivot point 130. The bell crank can respond to the force by rotating around the solid pivot 830, causing the bell crank 820 to rotate towards the pivot point 130 while the hinge pivot 840 moves towards the hinge 130 while rotating.

Other configurations using other types of lifting mechanisms can be implemented on one or more embodiments. In various embodiments, the lifting mechanisms 140 can include various mechanical (e.g., gears, actuators, solenoids, threaded screws, jacks, etc.), hydraulic, electrical (e.g., connected to electrical switches, triggers, actuators, etc.), and/or other types of mechanisms to provide force and/or torque to the moving portion 120. For example, a user can apply an input to an electrical switch to trigger an actuator-solenoid type of lifting mechanism to move the moving portion 120.

Figure 9:
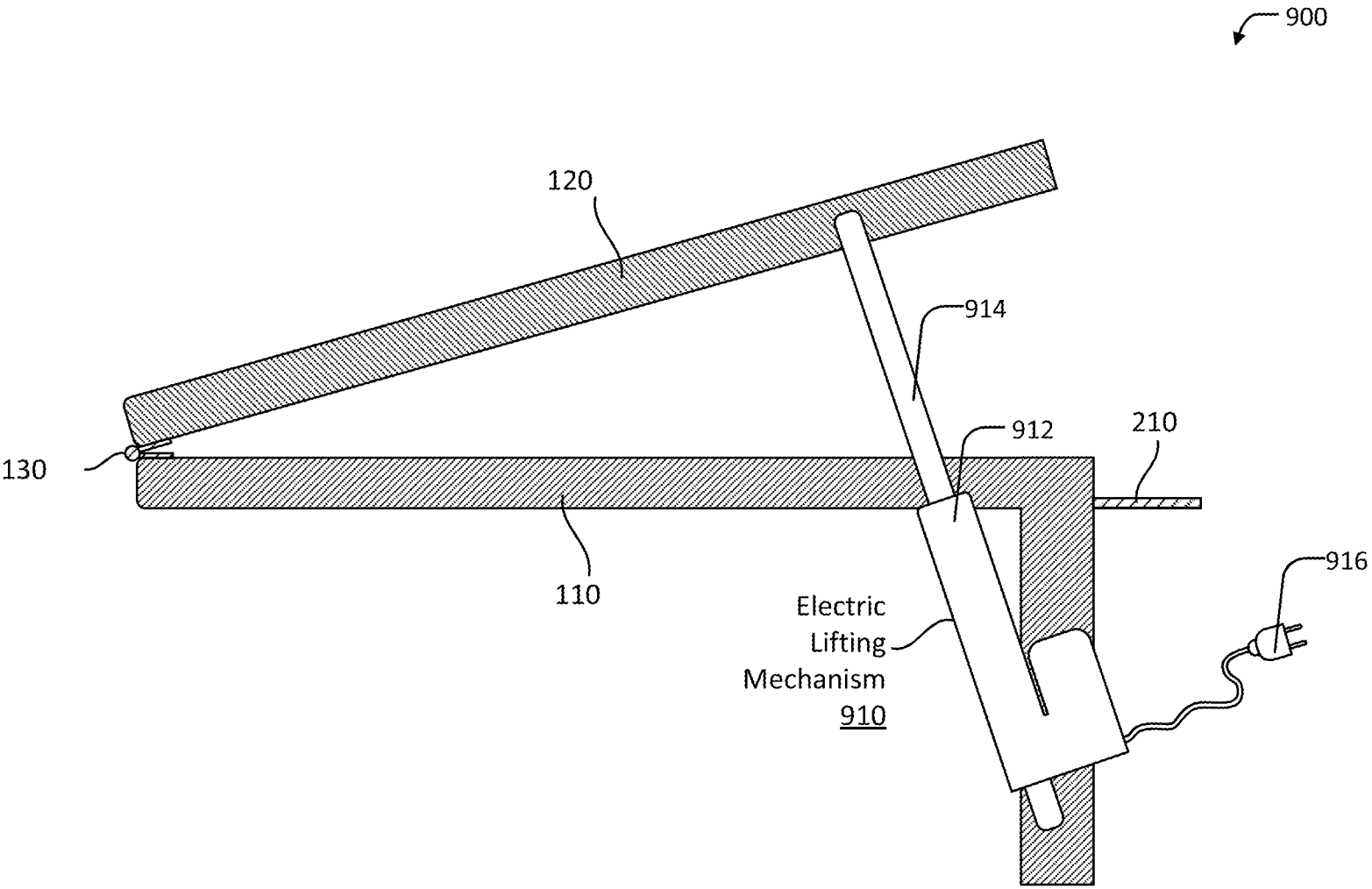
FIG. 9 illustrates a side view of the toilet seat lifting assembly of FIG. 1 that includes an electronic lifting mechanism, according to various embodiments.

FIG. 9 illustrates a side view of the toilet seat lifting assembly 100 of FIG. 1 that includes an electronic lifting mechanism, according to various embodiments. As shown, the toilet seat lifting assembly 900 includes, without limitation, the base assembly 110, the movable portion 120, the pivot point 130, mounts 210, and the electric lifting mechanism 910. The electric lifting mechanism 910 includes, without limitation, an electric housing 912, a piston 914, and an electrical connection 916.

In operation, the electric lifting mechanism 910 can receive electric power via the electrical connection 916 and can convert the electrical energy to mechanical energy to lift the movable portion 120 via the piston 914. In some embodiments, the electric lifting mechanism 910 can include an electronic trigger (not shown) that responds to various types of inputs by causing the electric lifting mechanism 910 to move the piston 914.

Figure 10:
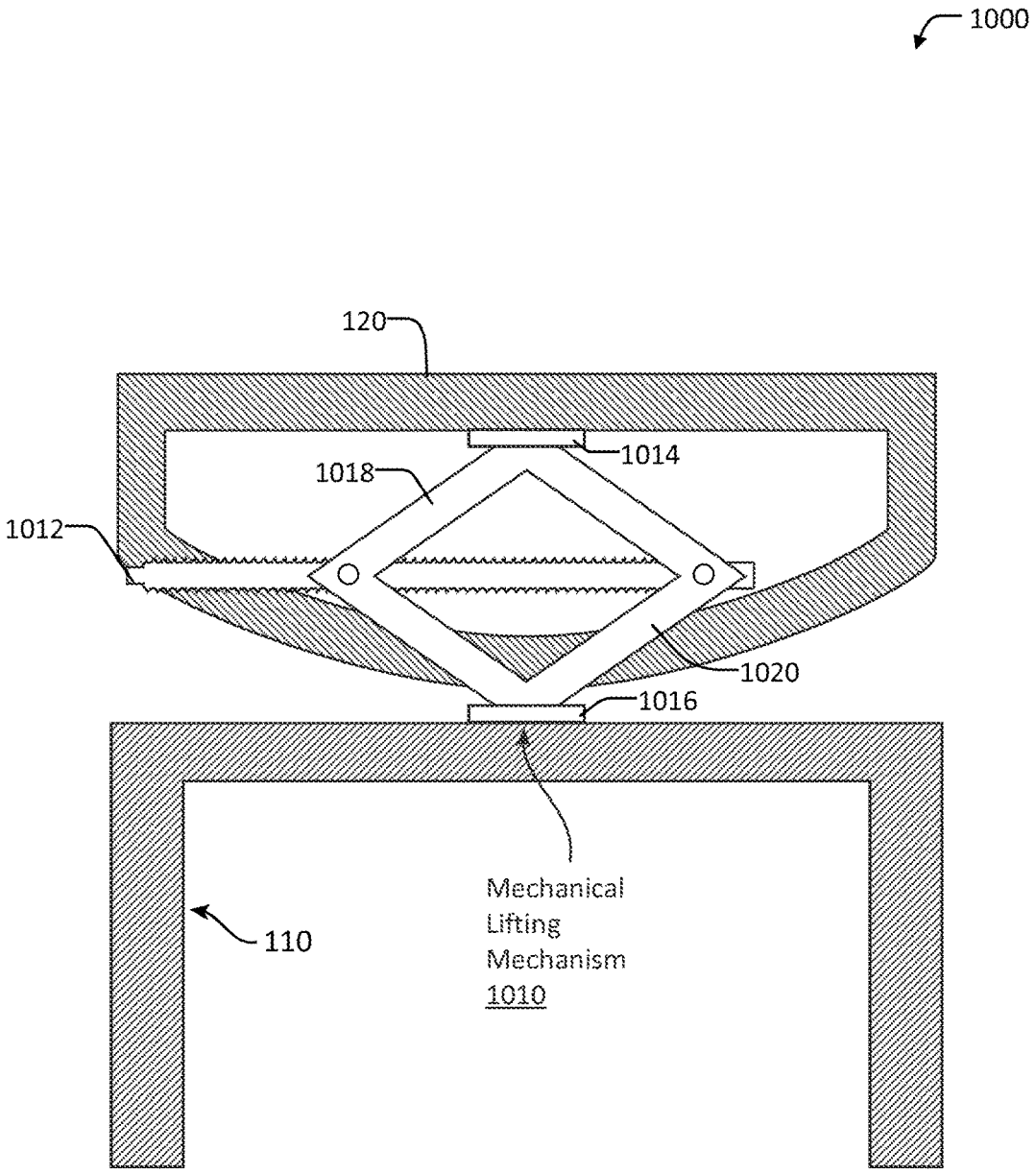
FIG. 10 illustrates a back view of the toilet seat lifting assembly of FIG. 1 that includes an alternative mechanical lifting mechanism, according to various embodiments.

FIG. 10 illustrates a back view of the toilet seat lifting assembly of FIG. 1 that includes an alternative mechanical lifting mechanism, according to various embodiments. As shown, the toilet seat lifting assembly 1000 includes, without limitation, the base assembly 110, the movable portion 120, and the mechanical lifting mechanism 1010. The mechanical lifting mechanism 1010 includes, without limitation, an arm 1012, a top 1014, a base 1016, upper arms 1018 and lower arms 1020.

In various embodiments, the mechanical lifting mechanism 1010 can connect to the base assembly 110 and the movable portion 120 at the back of the toilet seat lifting assembly 1000. For example, the top of the mechanical lifting mechanism 1010 can attach to the back of the movable portion 120 at the opposition end to the location of the pivot point 130. The base 1016 can connect to the base assembly 110. In operation, the user can apply a force to the arm 1012 and the arm 1012 can cause the upper arms 1018 to pivot at the top 1014 and the lower arms 1020 to pivot at the base 1016. In such instances, the movement of the arms 1018, 1020 can provide an upward force to the moveable portion 120 that causes the moveable portion 120 to transfer the force to a user sitting on a toilet seat 410 attached to the movable portion 120.

1. In various embodiments, an apparatus comprises a base assembly configured to be positioned around or on a base of a toilet, a movable portion mechanically coupled to the base assembly, and a set of lifting components that lift the movable portion away from a portion of the base assembly.

2. The apparatus of clause 1, further comprising a hinge that mechanically couples the movable portion to a top portion of the base assembly.

3. The apparatus of clause 1 or 2, where the set of lifting components lifting the movable portion causes the movable portion to rotate from the top portion of the base assembly around a pivot point at the hinge.

4. The apparatus of any of clauses 1-3, further comprising a set of mounts configured to fix the base assembly to a portion of the toilet.

5. The apparatus of any of clauses 1-4, where the movable portion further comprises a set of attachment areas configured to fix the movable portion to a toilet seat attached to the base.

6. The apparatus of any of clauses 1-5, where the at least one of the base assembly or the movable portion comprises a steel material.

7. The apparatus of any of clauses 1-6, where the set of lifting components comprises at least one of a hydraulic shock or a strut.

8. The apparatus of any of clauses 1-7, where the hydraulic shock or strut is fixed to a top portion of the base assembly, and the set of lifting components further comprises at least one bell crank fixed to the movable portion at a first end and fixed to the hydraulic shock or the strut at a second end.

9. The apparatus of any of clauses 1-8, where the set of lifting components initiates lifting the movable portion in response to a shift in a downward force applied to the movable portion.

10. The apparatus of any of clauses 1-9, where the set of lifting components are configured to be fixed at a first end to a leg of the base assembly and fixed at a second end to the movable portion.

11. The apparatus of any of clauses 1-10, where the base assembly comprises at least four legs.

12. The apparatus of any of clauses 1-11, further comprising a set of attachment mechanisms configured to mechanically couple the set of lifting components to the base assembly and the movable portion, where the set of attachment mechanism comprises at least one of a roller bearing, a mounting slot, mounting bracket or a fixing mechanism.

13. The apparatus of any of clauses 1-12, further comprising a switch that triggers the set of lifting components to lift the movable portion.

14. In various embodiments, a toilet seat lifting assembly comprises a base assembly configured to be fixed to a toilet base at a first point, a movable portion mechanically configured to be attached to a toilet seat and mechanically coupled to the base assembly at a second point distinct from the first point, and a set of lifting components that mechanically lift the movable portion away from a top portion of the base assembly.

15. The toilet seat lifting assembly of clause 14, further comprising a hinge that mechanically couples the movable portion to a top portion of the base assembly, where the set of lifting components mechanically lifting the movable portion causes the movable portion to rotate from the top portion of the base assembly around a pivot point at the hinge.

16. The toilet seat lifting assembly of clause 14 or 15, further comprising a set of mounts configured to fix the base assembly to a portion of the toilet, where the set of lifting components mechanically lifting the movable portion causes the movable portion rotates away around the pivot point from set of mounts.

17. The toilet seat lifting assembly of any of clauses 14-16, where the set of lifting components initiates lifting the movable portion in response to a shift in a downward force applied to the movable portion away from the set of mounts.

18. The toilet seat lifting assembly of any of clauses 14-17, where the lifting component comprises at least one strut fixed to the top portion of the base assembly, and at least one bell crank fixed at a first end to the movable portion and fixed at a second end to the strut.

19. The toilet seat lifting assembly of any of clauses 14-18, where the set of lifting components comprises a hydraulic shock configured to be fixed at a first end to a leg of the base assembly and fixed at a second end to the movable portion.

20. The toilet seat lifting assembly of any of clauses 14-19, where the movable portion further comprises a set of attachment areas configured to fix the movable portion to a toilet seat.

Any and all combinations of any of the claim elements recited in any of the claims and/or any elements described in this application, in any fashion, fall within the contemplated scope of the present invention and protection.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

While the preceding is directed to embodiments of the present disclosure, other and further embodiments of the disclosure may be devised without departing from the basic scope thereof, and the scope thereof is determined by the claims that follow.

We claim:

1. An apparatus for lifting an object sitting on a toilet, the apparatus comprising:

a base assembly having (i) a set of mounts positioned at a first end of the base assembly and (ii) a hinge positioned at a second end of the base assembly opposite from the first end, wherein the base assembly is mountable on a base of a toilet via the set of mounts, and wherein every portion of the base assembly, when mounted on the base of the toilet, is elevated from a ground on top of which the toilet is positioned;

a movable portion mechanically coupled to the base assembly via the hinge, wherein the movable portion transitions between a resting position on top of at least a portion of the base assembly and a lifted position away from the at least a portion of the base assembly; and a set of lifting components that lift the movable portion from the resting position to the lifted position in response to a weight shifting movement of an object sitting on the toilet.

2. The apparatus of claim 1, wherein the set of lifting components lifting the movable portion causes the movable portion to rotate from the top portion of the base assembly around a pivot point at the hinge.

3. The apparatus of claim 1, wherein the set of mounts fix the base assembly to the toilet.

4. The apparatus of claim 1, wherein the movable portion further comprises a set of attachment areas configured to fix the movable portion to a toilet seat attached to the base.

5. The apparatus of claim 1, wherein the at least one of the base assembly or the movable portion comprises a steel material.

6. The apparatus of claim 1, wherein the set of lifting components comprises at least one of a hydraulic shock or a strut.

7. The apparatus of claim 6, wherein:

the hydraulic shock or strut is fixed to the base assembly, and the set of lifting components further comprises at least one bell crank fixed to the movable portion at a first section of the movable portion and fixed to the hydraulic shock or the strut at a second section of the movable portion.

8. The apparatus of claim 1, wherein the weight shifting movement comprises a shift in a downward force applied to the movable portion.

9. The apparatus of claim 1, wherein the set of lifting components are configured to be fixed at a first end to a leg of the base assembly and fixed at a second end to the movable portion.

10. The apparatus of claim 1, further comprising a set of attachment mechanisms configured to mechanically couple the set of lifting components to the base assembly and the movable portion, wherein the set of attachment mechanism comprises at least one of a roller bearing, a mounting slot, mounting bracket or a fixing mechanism.

11. A toilet seat lifting assembly comprising:

a base assembly having (i) a set of mounts positioned at a first end of the base assembly and (ii) a hinge positioned at a second end of the base assembly opposite from the first end, wherein the base assembly is mountable on a base of a toilet via the set of mounts, and wherein every portion of the base assembly, when mounted on the base of the toilet, is elevated from a ground on top of which the toilet is positioned;

a movable portion mechanically coupled to the base assembly via the hinge, wherein the movable portion transitions between a resting position on top of at least a portion of the base assembly and a lifted position away from the at least a portion of the base assembly; and a set of lifting components that lift the movable portion from the resting position to the lifted position in response to a weight shifting movement of an object sitting on the toilet.

12. The toilet seat lifting assembly of claim 11, wherein the set of lifting components mechanically lifting the movable portion causes the movable portion to rotate from the top portion of the base assembly around a pivot point at the hinge.

13. The toilet seat lifting assembly of claim 12, further comprising a set of mounts configured to fix the base assembly to a portion of the toilet, wherein the set of lifting components mechanically lifting the movable portion causes the movable portion rotates away around the pivot point from set of mounts.

14. The toilet seat lifting assembly of claim 13, wherein the weight shifting movement comprises a shift in a downward force applied to the movable portion away from the set of mounts.

15. The toilet seat lifting assembly of claim 11, wherein the lifting component comprises:

at least one strut fixed to the top portion of the base assembly; and at least one bell crank fixed at a first end to the movable portion and fixed at a second end to the strut.

16. The toilet seat lifting assembly of claim 11, wherein the set of lifting components comprises a hydraulic shock configured to be fixed at a first end to a leg of the base assembly and fixed at a second end to the movable portion.

17. The toilet seat lifting assembly of claim 11, wherein the movable portion further comprises a set of attachment areas configured to fix the movable portion to a toilet seat.

* * * * *